US005678372A

United States Patent [19]

Thomson et al.

[11] Patent Number: 5,678,372

[45] Date of Patent: Oct. 21, 1997

[54] SYSTEM FOR BUILDING CONSTRUCTION USING PREFORMED, REINFORCED CONCRETE PANELS

[75] Inventors: Donald W. Thomson, San Jose, Costa Rica; Frank B. Nichols, Redding, Calif.

[73] Assignee: Constru-Plus Internacional, S.A., Alajuela, Costa Rica

[21] Appl. No.: 562,266

[22] Filed: Nov. 22, 1995

[51] Int. Cl.[6] ..... E04B 1/02

[52] U.S. Cl. ..... 52/432; 52/259; 52/299; 52/262; 52/272; 52/287.1; 52/442; 52/583.1; 52/745.1; 52/745.13

[58] Field of Search ..... 52/251, 259, 299, 52/294, 583.1, 260, 587.1, 432, 442, 745.09, 745.1, 745.13, 742.14, 270, 272, 284, 262, 287.1

[56] References Cited

U.S. PATENT DOCUMENTS

| | | | |
|---|---|---|---|
| 1,379,636 | 5/1921 | Lydon | 52/583.1 |
| 2,359,304 | 10/1944 | Davison | 52/299 |
| 2,673,459 | 3/1954 | Overhulse | 52/259 |
| 3,530,631 | 9/1970 | Guddal | 52/742.1 X |
| 3,968,615 | 7/1976 | Ivany | 52/259 X |
| 4,793,104 | 12/1988 | Hultberg et al. | 52/442 X |
| 4,909,001 | 3/1990 | Gonzalez Espinosa de Los Monteros | 52/251 X |
| 5,216,860 | 6/1993 | Thomson et al. . | |

FOREIGN PATENT DOCUMENTS

| | | | |
|---|---|---|---|
| 699130 | 11/1979 | U.S.S.R. | 52/251 |
| 6325 | of 1905 | United Kingdom | 52/583.1 |

*Primary Examiner*—Michael Safavi
*Assistant Examiner*—Timothy B. Kang
*Attorney, Agent, or Firm*—Townsend and Townsend and Crew

[57] ABSTRACT

Adjacent reinforced, preformed wall panels are joined to one another by a wet-knit joint. The confronting edges of the wall panels are formed to have an undulating pattern of alternating convex, concave segments having ends of reinforcement bars extending from the concave segments. The reinforcement bar ends are connected to an arrangement of elongate bars and a zig-zag reinforcement bar, that knits the wall panels together. The wet-knit joint is completed by the introduction of concrete, or other pourable material, that, when cured, creates a strong connection between the wall panels.

25 Claims, 8 Drawing Sheets

SYSTEM FOR BUILDING CONSTRUCTION USING PREFORMED, REINFORCED CONCRETE PANELS

BACKGROUND OF THE INVENTION

The present invention is directed to building construction, and more particularly to building construction methods and apparatus for interconnects preformed, reinforced concrete panels to form a unitary structure.

The building industry has long known the advantages of using reinforced concrete. Those advantages include higher fire ratings as compared to many other construction materials, better seismic resistance, higher resistance to abuse and normal wear and tear and reduced material and labor cost in many instances. For those less affluent seeking affordable, but appropriate housing, prefabricated construction may be the answer.

However, prefabricated construction is not without certain problems. If the preformed panels used are inappropriately prepared (i.e., without proper reinforcement) seismic resistance is substantially reduced. Further, joining adjacent panels with linear columns will often subsequently result in cracking along the lines of the columns as the structure settles, or is subjected to the forces of nature.

SUMMARY OF THE INVENTION

The present invention provides a building construction system, employing reinforced pre-fabricated wall, floor, and roof panels, interconnected in a way that produces a substantially integral, unitary structure with improved transfer of loads and stresses through component parts of the structure, resulting from external forces. This improved load/stress transfer tends to reduce damage by seismic activity or other forces of nature, as well as damage from abuse and maltreatment. The system is easy to use, is less labor-intensive than other construction methods, and is amenable to using less, expensive materials, reducing the cost of building construction.

Broadly, the invention is directed to a system of building construction, using preformed, reinforced concrete panels, interconnect adjacent panels in a manner that securely ties the panels to one another, forming an integrated, unitary structure. The panels used in the system are constructed with reinforcement bars having terminal end portions that extend from opposite peripheral edges of the panels. The panels are, in turn, formed to have undulating pattern of alternating convex, concave sections. The terminal ends of the reinforcement bars protrude from the concave sections. The interconnection employs a pair of vertically oriented, elongate reinforcement bars, and a zig-zag shaped reinforcement bar, that is fastened to the horizontal reinforcement bars that extend through the panels. The convex sections have formed therein a vertical groove that receives and holds a corresponding one of the linear reinforcement bars.

The undulating edges of two adjacent panels are located in spaced, confronting relation with the zig-zag reinforcement bar located in the space between the two undulating edges. The bends of the zig-zag reinforcement bar are positioned proximate the protruding ends of the reinforcement bars of the panel. The protruding ends of the horizontal reinforcement bars are then contorted or bent to wrap around and capture both the associated vertical elongate reinforcement bar, and the zig-zag reinforcement bar. Forms are then used to close off the space between the confronting panel surfaces, and a pourable material, such as concrete, introduced therein that hardens to, form a knitted wet joint securely tying the two panels to one another. In further embodiments of the invention, the same technique is used to join three wall panels at their adjacent edges (two panels being, to adjacent co-planar, the third normal to the other two). Panels situated to form a 90° corner are similarly connected by a similarly constructed knitted wet-joint.

In still further embodiments of the construction system of the present invention, footing elements are used to perform two functions: to provide a support for the wall panels (and floor panels) of the building structure, and to provide a structure that can hold the sidewall slats used to construct a form for a foundation that will include the footing elements, fastening the footing elements and wall panels to one another through the foundation.

Preferably, the footing elements are placed in a poured, still wet, sub-foot support. The upper surfaces of all footing elements are aligned so that they lie in substantially the same plane. The foundation forms, floor panels, and wall panels are set in place on the footing elements, and a pourable material (cement) introduced to form the foundation and the knitted wet joints described above. The wall panels will preferably be formed to include vertical reinforcement bars (in addition to the horizontal reinforcement bars used in the vertical knitted wet joints) with extensions that protrude beyond the bottom surface of each wall panel, and into the foundation so that when the foundation is poured and hardened, the wall panels are integrally connected, not only to one another, but to the foundation.

In yet a further embodiment, pre-fabricated, reinforced concrete panels are also used for the roof structure. The roof structure panels are supported by a cornice clip, an element that attaches at the upper, generally horizontal peripheries of the interior corners of the wall panels to position and hold the wall panels to which the cornice clip attaches during construction.

A number of advantages are provided by the construction system of the present invention. The knitted wet joint used to join adjacent prefabricated, reinforced panels creates a strong tie between the wall panels, functioning to distribute loads and stresses in a manner that increases resistance to seismic activity, and to other forces of nature.

A further advantage is achieved in that the manner used to interconnect the elements (wall panels, foundation) serves to interlock the component elements to create a unitary structure. Interlocking adjacent panels in the manner according to the present invention allows them to move together in the face of horizontal sheer forces, minimizing cracking along the connecting joints.

A yet further advantage is achieved through the confronting, undulating peripheral edges of the wall panel. The undulations operate to further reduce the tendency for cracking, and isolates any cracking that will occur to short sections. The undulations of confronting, joined panel edges also provide an interlocking effect which assists the load and stress transfers from panel to panel.

A further advantage of the invention is the strong interconnecting tie operates to provide a field pre-tensioning of the reinforcement bars used to form the "knitting" of the joints connecting adjacent panels to one another. This pre-tensioning feature provides an efficient transfer of forces.

Still another advantage of the invention is found in the use of the corner clip used, in the first instance, to "square" the corners of perpendicularly-oriented adjacent walls; and in a second instance to hold the two walls without the normal bracing usually used in pre-fabricated construction of the type to which the present invention is directed. This latter advantage, in turn, reduces or obviates the need for braces to hold wall panels during construction, reducing the number of braces that may be needed, and creating a safer work area by reason of the lack of braces.

These and other advantages and features of the invention will become apparent to those skilled in the art upon a reading of the following detailed discussion, which should be taken in conjunction with the accompanying drawings.

DESCRIPTION OF THE PREFERRED EMBODIMENT

Figure 1:
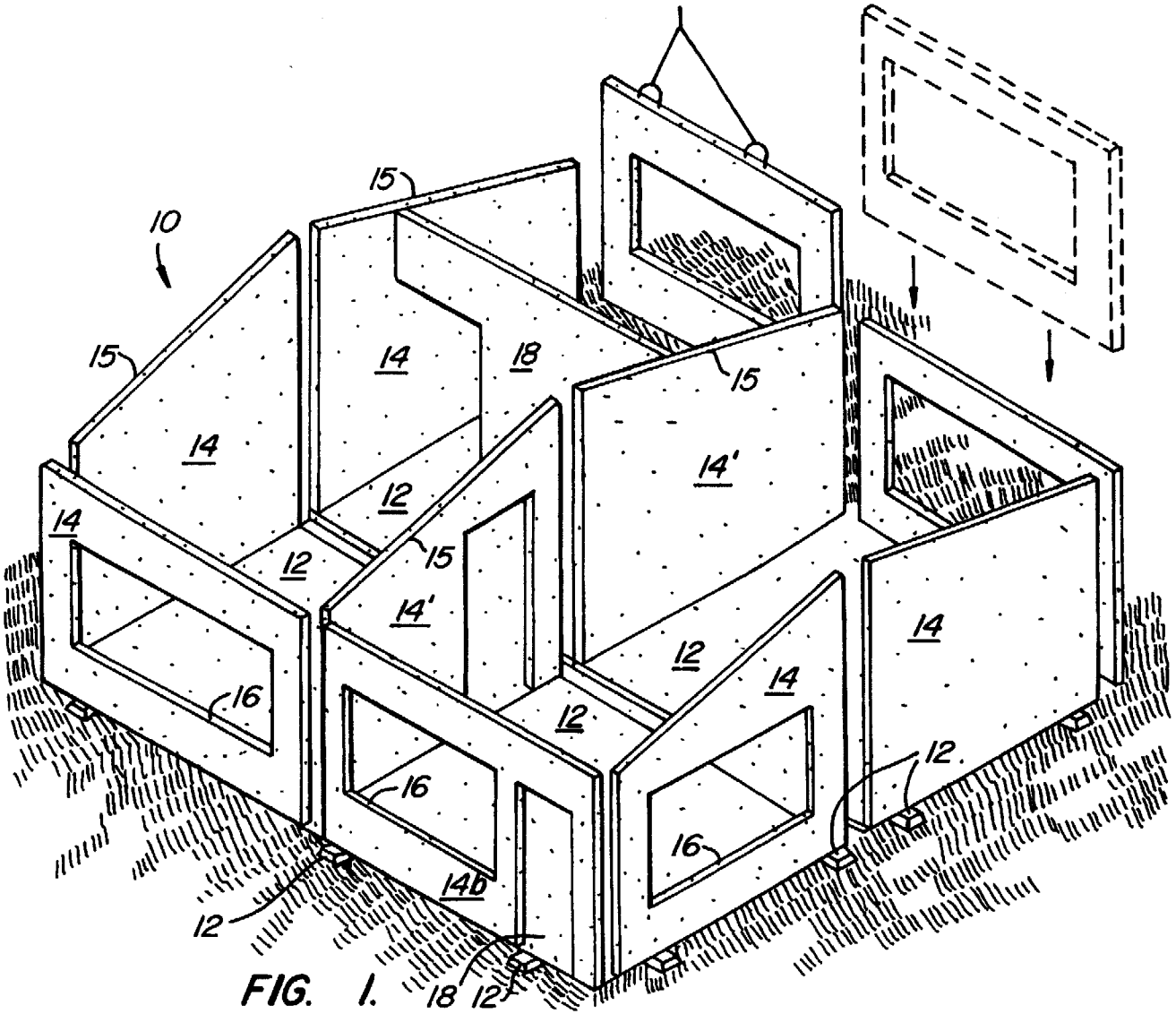
FIG. 1 is a perspective representation of the type of building construction to which the present invention is directed.
Figure 2:
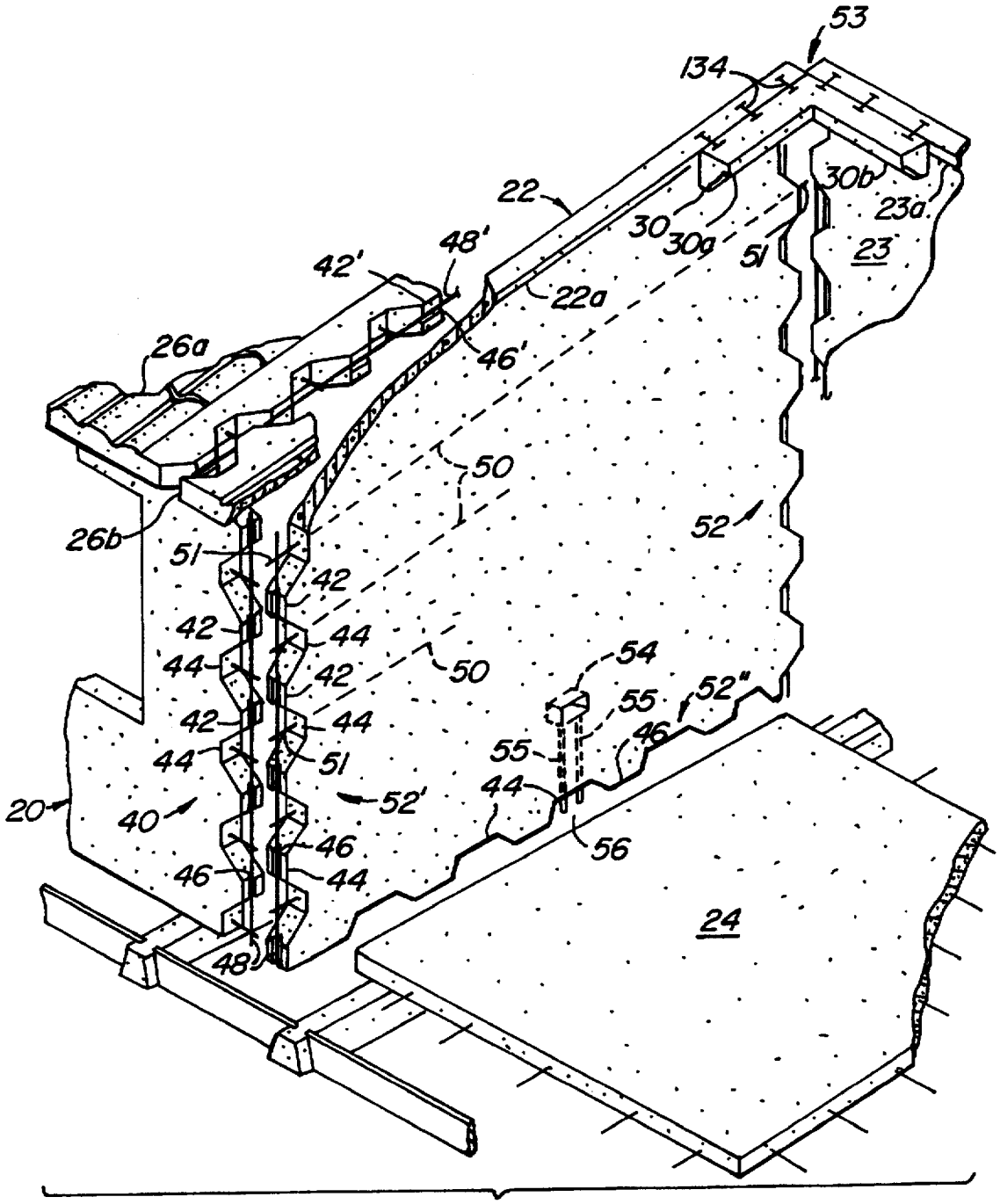
FIG. 2 is an isometric view of a portion of a building construction incorporating elements of the construction system of the present invention to interconnect adjacent wall and roof panels.

Turning now to the figures, and for the moment to FIG. 1, there is illustrated a building construction of the type to which the present invention is directed. The building construction, designated generally with the reference numeral 10, is shown employing the use of preformed, reinforced concrete panels as floor panels 12 and wall panels 14. According to the construction system of the present invention, the roof panels (26*a*, 26*b*; FIG. 2) are also preformed, reinforced concrete. As FIG. 1 illustrates, certain of the wall panels 14 are constructed to include window openings 16 and door openings 18.

The structure 10 may include interior wall panels 14' to divide the interior space of the structure 10 as desired. As FIG. 1 also illustrates, certain of the wall panels 14 (here, including interior wall panels 14') are constructed with an angled or sloping edge periphery 15 to provide support for roof panels (not shown in FIG. 1) in pitched configuration.

As will be seen, the wall panels 14, 14' are preformed and reinforced by reinforcement bars that extend both horizontally and vertically when the wall panel is in place. Similar reinforcement is provided in roof and floor panels. The reinforcement bars extend both in the horizontal and vertical directions, from one edge of the wall (and roof) panels to the other, to protrude therefrom for binding the wall panel to its adjacent neighbor(s) in a manner discussed more fully below. As will be seen, all vertical edges of the wall panels 14, 14' shown in FIG. 1, and confronting edges of roof panels (not shown in FIG. 1; see 26*a*, 26*b*, FIG. 2), are constructed with a waffle or undulating pattern that operates with other elements of the system of the present invention to attach adjacent wall (and roof) panels to one another.

FIG. 1 is not intended to show the elements of present invention, but to show the generally the type of construction to which the teachings herein are applied. The remainder of this discussion will describe how the elements shown in FIG. 1 (the wall panels 14, roof panels—not shown in FIG. 1—and floor panels 12) are constructed according to the present invention.

Figure 3:
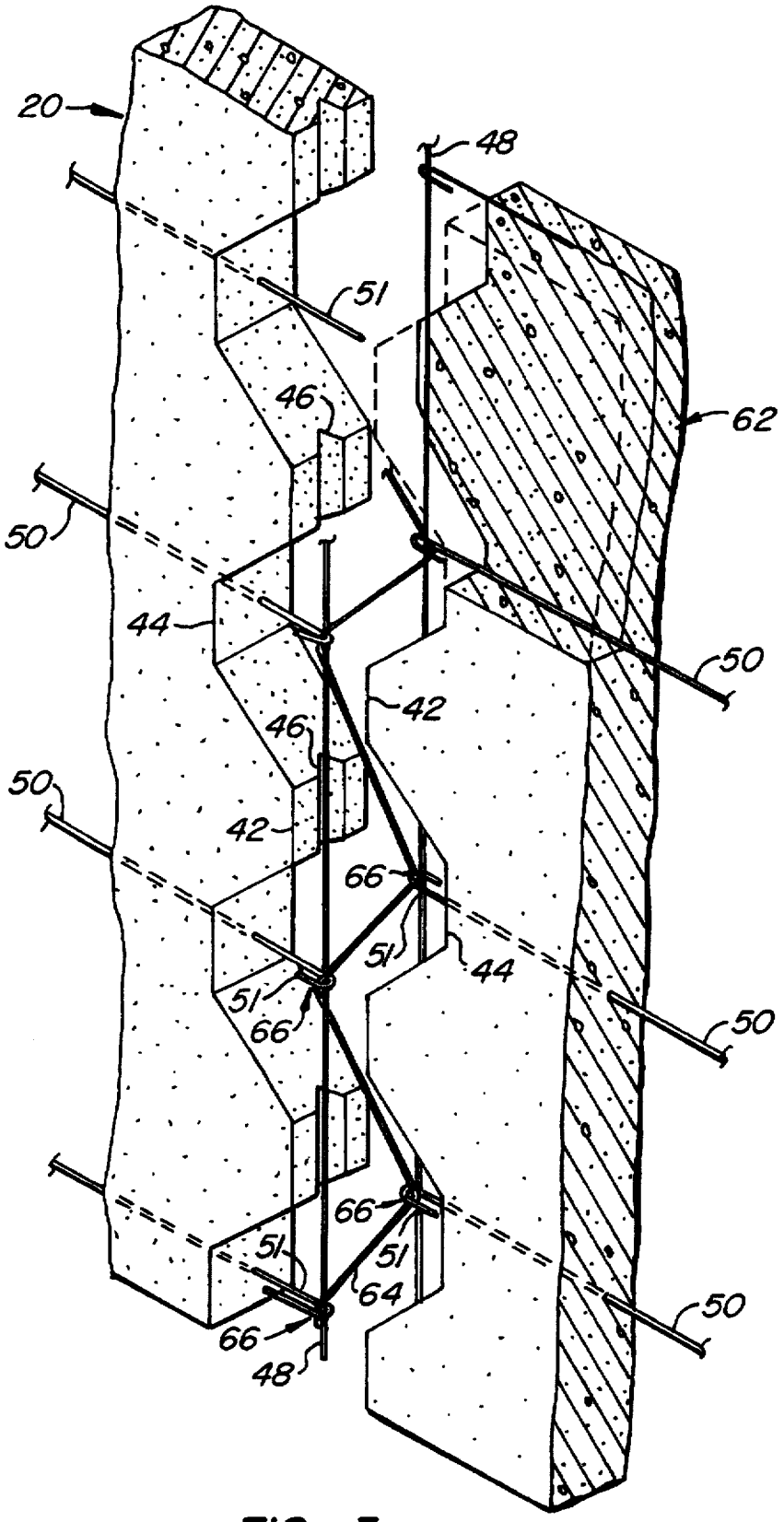
FIG. 3 is a partial, perspective, sectional view of adjacent wall panels, showing the undulations formed in confronting, peripheral edges of the wall panels, and the truss structure interconnecting one wall panel to the other.

Referring now to FIG. 2, there is shown a portion of a building construction that incorporates the teachings of the present invention. FIG. 2 shows wall panels 20, 22, a floor panel 24 and roof panel portions 26*a*, 26*b*. Not shown in FIG. 2, for reasons of clarity, is the wall panel that would be positioned in substantially the same plane as wall panel 20 (and normal to the wall panel 22). This missing wall panel is shown in FIG. 3, as wall panel 62. As FIG. 2 illustrates, the upper peripheral edges of the wall panels 20, 22 will support the roof panels 26*a*, 26*b*, with the added support provided by a support cornice member 30—which is discussed more fully below. To accommodate attachment of the cornice clip 30, all wall members are constructed to include a steel "C-channel" rail at the upper edge of the wall panel. Thus, as shown in FIG. 2, the wall panels 22 and 23 are shown with steel C-channels 22*a* and 23*a* fashioning their upper edges. Wall panel 20 also has such a steel C-channel forming its top edge (obscured in FIG. 2 by the roof panels 26*a* and 26*b*) as do all other wall panels used in the construction. The reasons for use of a steel C-channel will become clear in connection with the discussion of the cornice clip 30, below.

FIG. 2 illustrates the undulating peripheries of the wall panels 20, 22 and the roof panels 26*a*, 26*b*, used as a part of the interconnection scheme for joining adjacent panels together according to the present invention. The undulating pattern comprises alternating convex sections 42 and concave sections 44. It will be appreciated that all the wall panels of a building construction may be constructed to include undulating patterns of the present invention at the vertical and bottom edges. However, preferably, only certain of the wall panels may have their bottom edges formed with the undulating pattern.

In FIG. 2 only the wall panel 22 is shown with its bottom edge so patterned. The reason for this has to do with the electrical junction boxes that may be included in the wall panel construction—such as the electrical junction box 54 shown as being included in the wall panel construction of wall panel 22. Typically, such electrical junction boxes have conduits extending from the junction box for receiving electrical wiring. Thus, as FIG. 2 illustrates, the electrical junction box 54 has conduits 55 extending from the junction box, with stubs 56 extending from the bottom edge of the wall panel 22. It has been found that during transport of wall panels having no undulating bottom edges, the protruding stubs 56 were easily bent or broken. Forming the wall panel to include an undulating bottom edge, and locating the electrical junction box 54 to have the stubs 56 of the associated conduits brought out in one of the concave segments of the edge, allowed the adjacent convex segments 42 on either side of the concave segment containing the stubs to protect the stubs from harm during transport.

The panels 20, 22, 24 and 26 are preferably reinforced concrete, the reinforcement being provided by two sets of parallel, (number 3) reinforcement bars that extend from one edge of the panel to the other. As FIG. 2 illustrates, the horizontal reinforcement bars of the wall panel 22, designated generally with the reference numeral 50, extend from one vertical edge 52 of the wall panel to the other edge 52'. (Not shown for reasons of clarity are the set of reinforcement bars that extend transverse the horizontal reinforcement bars 50 in wall panel 22.)

The location and length of the reinforcement bars 50 contained by the wall panel 22 are such that the terminal ends 51 will protrude and extend from the concave segments 44 of the vertical edges 52. As can be seen in FIG. 2 with respect to the wall panel 22, the undulating pattern of the vertical edge 52 is offset by one convex (or concave) segment from that of the opposite edge. Thus, the horizontal reinforcement bars having terminus' 51 that extend from the vertical edge 52 will not have their other ends extending from the opposite vertical edge of the wall panel 22. Conversely, of course, those of the horizontal reinforcement bars 50 extending from the vertical edge opposite edge 52' will not also extend from edge 52.

As indicated above, the wall panel that would normally be located adjacent and co-planar with wall panel 20 was not illustrated in FIG. 2. However, it is shown in FIG. 3 as wall panel 62, and wall panel 22 is not shown in order to better illustrate the interconnection between the two co-planar wall panels 20, 62. FIG. 3 shows the undulating pattern of convex segments 42 and concave segments 44 of each such co-planar wall panels 20, 62 formed so that the convex segments 42 of wall panel 20 are horizontally aligned with the concave segments 44 of the wall panel 62.

As can be seen in FIG. 2, and as better illustrated in FIG. 3, each of the convex segments 42 of the undulating edge have formed therein a vertical notch or groove 46 for receiving a vertical reinforcement bar 48. Positioned in the space between the undulating peripheries of adjacent, co-planar wall panel 20, 62 is a zig-zag shaped reinforcement bar 64 (not shown in FIG. 2 in order to not unduly clutter that figure). The configuration of the zig-zag reinforcement bar 64 is such that each bend 66 of the zig-zag bar 64 will be located, when properly positioned in the manner shown in FIG. 2, proximate the terminal portions 51 of the horizontal reinforcement bars 50 protruding from each concave segment 44. The terminal ends of the horizontal reinforcement bars 50 of both wall panels 20, 62 are bent, or otherwise contorted, to capture both the vertical reinforcement bar 48 associated with the panel and the zig-zag reinforcement bar 64. The zig-zag reinforcement 64 acts as a bridge between the panels 20, 62 that knits them together.

In addition, when adjacent pairs of the reinforcement 50 bars are connected to the associated vertical reinforcement bar 48, they do so in a manner that will tension the vertical reinforcement bar 48 against the convex segments 44. That is, by capturing the vertical reinforcement bar with the ends 51 of the horizontal reinforcement bars 50, adjacent ones of the ends 51 will operate to induce a tendency to bend the bar 48 over or across the convex segment 42 between such two reinforcement bars. Further, the zig-zag reinforcement bar 64 is connected in such a way as to tend to pull those bends 66 toward the nearest wall panel. The result is a pre-tensioning of entire knitting structure, and its component parts, formed by the interconnected horizontal reinforcement bars 50, vertical reinforcement bars 48, and zig-zag reinforcement bars 64. This pre-tensioning provides an efficient vehicle for the transfer of forces between wall panels.

To complete the joining of the two panels, wooden (or any other material) planks or forms are placed adjacent the space between the confronting undulating edges of the panels 20, 62. A pourable material, such as concrete, is introduced into the space to form a wet knit, reinforced concrete column between the panels 20, 62, joining them together when hardened.

When the column so formed has cured, the vertically-oriented grooves 46 operate to perform an function in addition to nesting the vertical reinforcement bars 48; they serve to provide additional resistance to shear forces that may be exerted in directions lateral directions (relative to the groove), or generally transverse the associated wall panel.

FIG. 3 shows the technique of joining two co-planar wall panels according to the present invention. This same technique is applicable for joining other adjacent, co-planar panels, such as roof panels, as illustrated in FIG. 2, showing the mutually confronting edges of roof panels **26*a*, 26*b* with undulations of convex/concave segments. Both roof panels further have associated therewith elongate reinforcement bars 48' (shown in FIG. 2 only with respect to roof panel 26*a*) situated in the grooves 46' formed in the convex segments 42' of the roof panels. For clarity, the zig-zag reinforcement bar, corresponding to zig-zag reinforcement bar 64 (FIG. 3) is not shown in the space between the confronting roof panels 26*a*, 26*b*. But, it should be understood that the jointing of the roof panels 26*a*, 26*b* will include a zig-zag reinforcement bar that is captured at its bends to the ends of reinforcement bars that protrude from each roof panel 26*a*, 26*b* toward the other (and also attach to the elongate reinforcement bars 48')— in the same manner as illustrated in FIG. 3. Further, the space between the confronting edges of the roof panels 26*a*, 26*b* will be filled with concrete, encapsulating the truss structure (elongate bar 48', zig-zag reinforcement bar, and the connecting or capturing ends of reinforcement bars 50**).

In the same manner, the floor panels 24 (FIG. 2) could be formed to have undulating peripheries, although for reasons discussed below this is not believed necessary.

Figure 4:
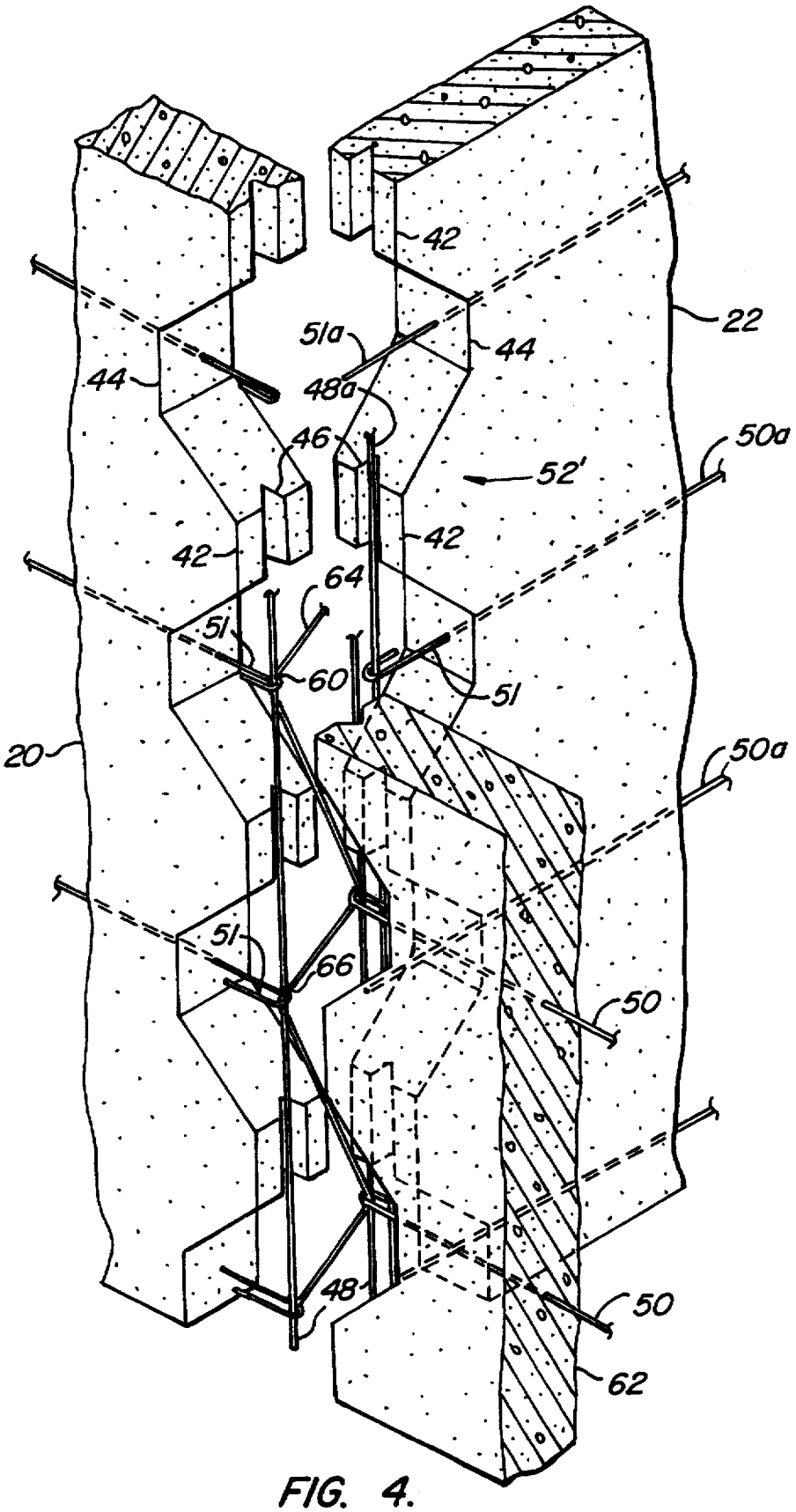
FIG. 4 is an illustration of the interconnection of three adjacent wall panels, one wall panel situated normal to the other.
Figure 5:
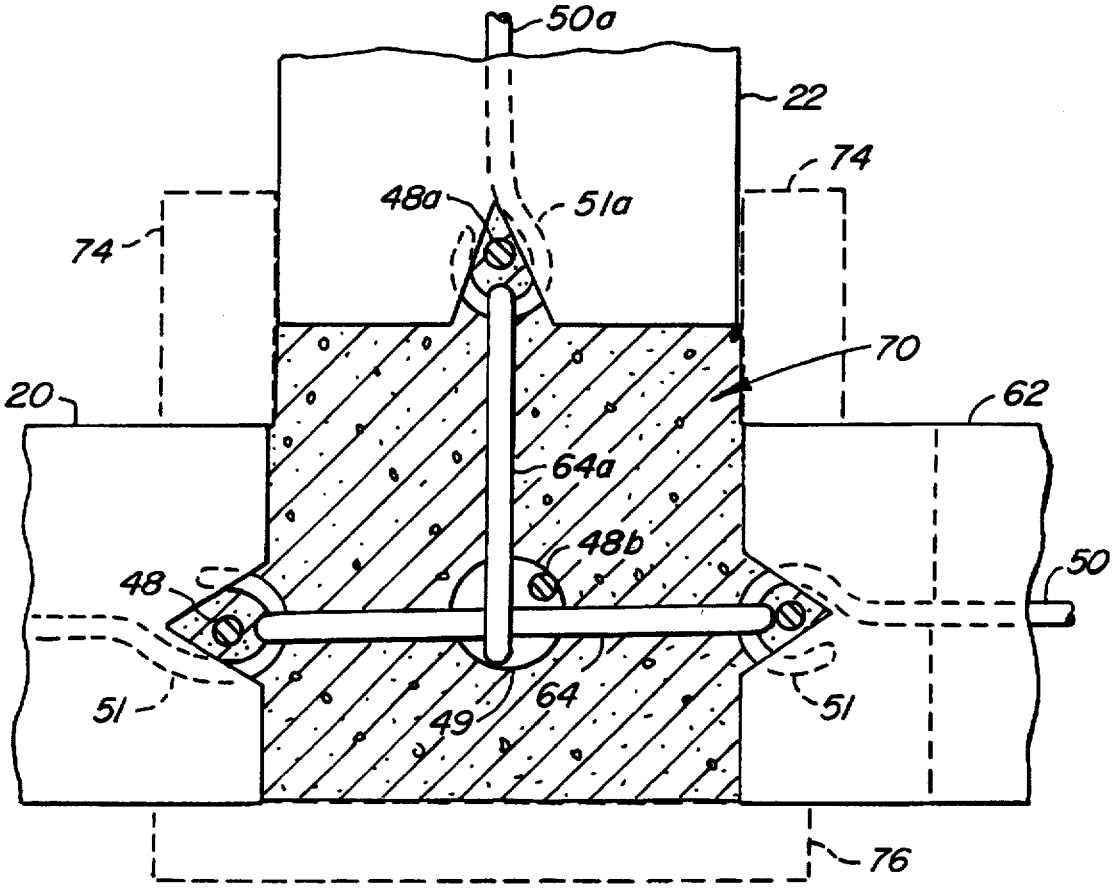
FIG. 5 is a top plan view of the wet knit joint formed between adjacent edges of the wall panels shown in FIG. 4.

Turning to FIGS. 4 and 5, formation of a wet knit column to join three adjacent panels, one normal to the other two, is illustrated. As shown in the perspective view of FIG. 4, the edge 52' of the normal wall panel 22 is, like that of the co-planar wall panels 20, 62, formed to have undulations of convex/concave segments 42/44; and, like wall panels 20, 62, an elongate reinforcement bar **48*a* is associated with the wall panel 22—situated in the grooves 46 formed in the convex segments 42**.

Like the zig-zag reinforcement bar 64 associated with wall panels 20, 62, a substantially identical zig-zag reinforcement bar **64*a* is associated with wall panel 22. (The zig-zag reinforcement bar 64*a* is not specifically shown in FIG. 4 for reasons of clarity; it is illustrated in the top plan view of the wall panels 20, 22, 62 shown in FIG. 5). The zig-zag reinforcement bar 64*a* is positioned so that its bends (i.e., the changes of direction) nearest the wall panel 22 will be located proximate the terminal portions 51*a* of the horizontal reinforcement bars 50*a* protruding from the wall panel 22. This places them in a position to be contorted or otherwise bent (as illustrated in FIG. 5) to capture and hold both the vertical reinforcement bar 48***a* and the zig-zag reinforcement bar 64*a*.

Before the concrete is poured to complete the column that will join the wall panels 20, 22, 62, an additional vertical, elongate reinforcement bar 48*b* is positioned in the void between the undulating edges of the wall panels 60, 62, proximate both the zig-zag reinforcement bar 64 associated with wall panels 20, 62, and the zig-zag reinforcement bar 64*a*. Wiring 49 encircles the elongated vertical reinforcement bar 48*b*, and portions of the reinforcement bars 64, 64*a* at locations along the vertical elongate reinforcement bar 48*b* where the bends of the zig-zag reinforcement bar 64*a* and portions of the zig-zag reinforcement bar 64 are adjacent each other to hold them in a substantially normal position relative to one another.

The column is formed by first placing forms 74, 76 (illustrated, in FIG. 5, in phantom) to close off the space or area formed by the adjacent undulating edges of the wall panels 20, 22, 62. A pourable material 70 (concrete) is then introduced to form a reinforced, concrete column joining the wall panels 60, 62, 70 to one another.

Figure 6:
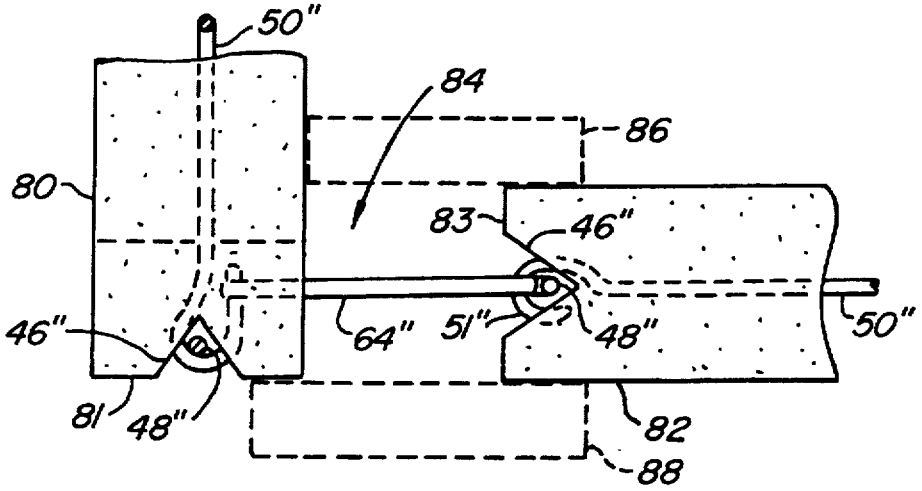
FIG. 6 is a top plan view illustrating the wet knit joint formed between adjacent wall panels situated to form a 90° exterior corner.

Turning now to FIG. 6, there is illustrated, in top plan view, connection of two adjacent wall panels 80, 82 placed to form a corner of a structure according to the present invention. It should be understood that the vertical edges 81, 83 of the wall panels 80, 82 are formed to have the same undulating pattern of convex and concave segments as the wall panels 20, 22, 62 (FIGS. 3 and 4). As FIG. 6 shows, both wall panels 80, 82 have associated therewith (located in grooves 46" that are formed in the convex segments of the edges 81, 83) vertical reinforcement bars 48". Each wall panel 80, 82 is also formed (as were wall panels 20, 22, 62) to contain horizontal reinforcement bars 50" at least one terminus 51'" of which would protrude from a concave segment (not visible in FIG. 6) to bend around the associated vertical reinforcement bar 48" and the bend portions of a zig-zag reinforcement bar 64". A reinforced concrete joining column can then be formed by closing the area 84 between confronting surfaces of the wall panels 80 and 82 with vertical forms 86, 88, illustrated in phantom, and introducing a pourable concrete that is allowed to harden.

Referring back, for the moment, to FIGS. 1 and 2, the illustrations of the building structure 10 show the wall and floor panels supported on the ground surface by footing 12. These footings perform a three-fold function: first they provide support to the structure 10 itself through the wall and floor panels; second, they are structured (as will be seen) to hold the side panels of a foundation form used to produce a foundation for the structure; and third, they are included in the foundation ultimately produced to interconnect the foundation of the building structure.

Figure 7:
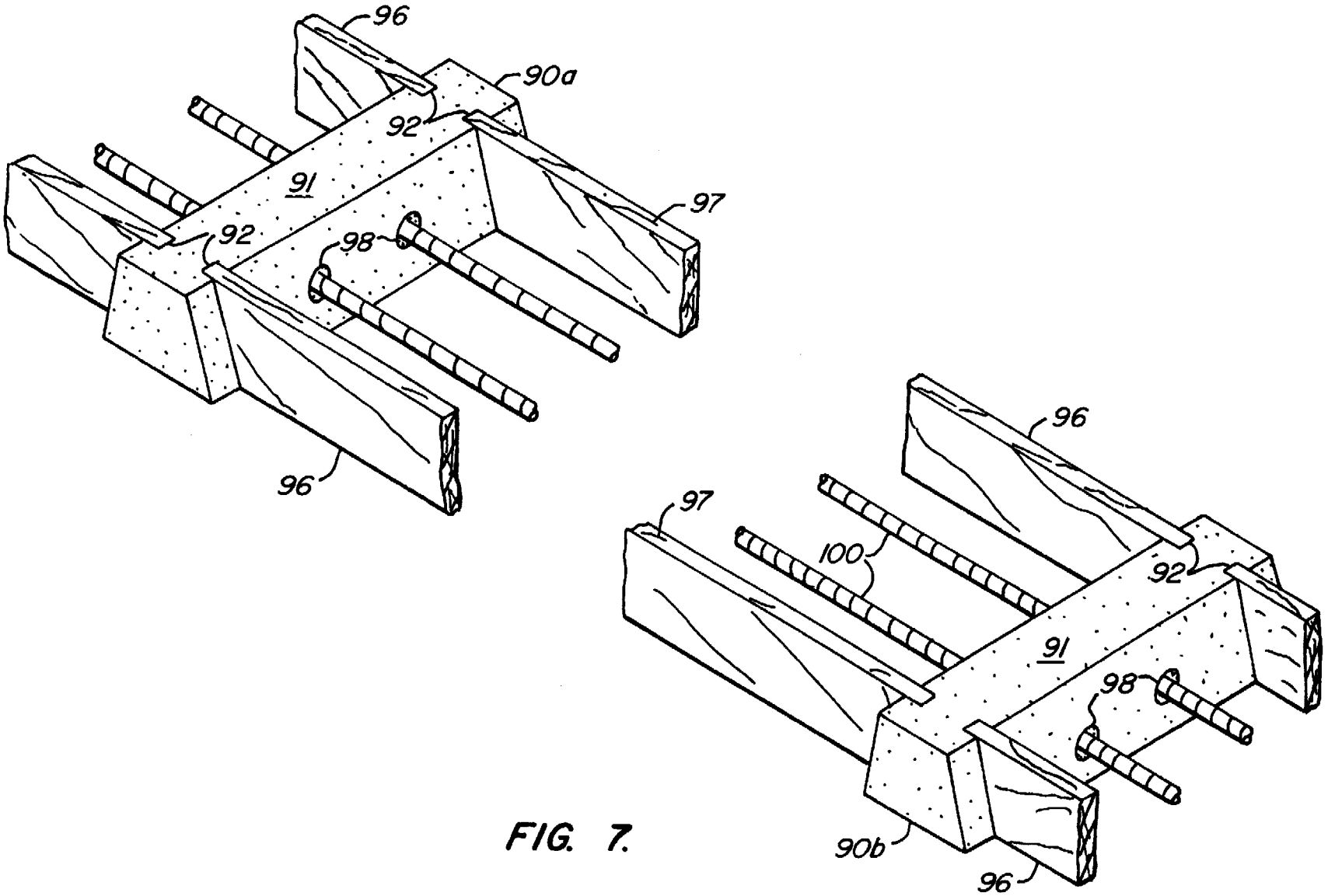
FIG. 7 is a perspective illustration of the footing elements that are incorporated into the foundation of a building structure, according to the present invention, to support wall members of the building structure, and to hold the sidepanel forms used to construct a building foundation.

Referring now to FIG. 7 two of the footings, designated generally with the reference numerals 90 (90*a*, 90*b*), are shown. Preferably, each footing 90 is constructed of reinforced concrete, and each is formed to have four vertical grooves 92 configured to receive and hold foundation form side panels 96. Also formed in each footing 90, transverse therethrough, are apertures 98 that receive and pass elongate reinforcement bars 100 that extend through the footing 90*a* to and through the other footing 90*b*.

The side panels 96 (typically wood) define the height and width of the foundation that will be formed for a structure. Preferably, the transverse dimension of each sidepanel is such that the top edge 97 of each will lie generally in a plane that includes the top surfaces 91 of the footings 90. Since the bottom edges of wall panels of a structure (e.g., wall panels 20, 22, 62, 80, 82; FIGS. 3–6) will rest on and be supported by the top surfaces 91, using sidepanels of sufficient width allows a foundation to be produced that joins with and extends from the structure's wall panels to the surface upon which the structure is built.

In practice, the boundary of the structure to be built would be marked on the building site. The marking will include marking to delineate where any interior wall panels of the structure will be located—such as the interior wall panels 14' shown in FIG. 1. Then, footings 90 are positioned at a number of locations along the marking. At least two of the footings 90 for each separate wall panel of the structure will be used, each placed proximate a vertical edge of the supported wall panel, although more footings 90 may be used if the wall panel is sized to require more support.

Figure 8:
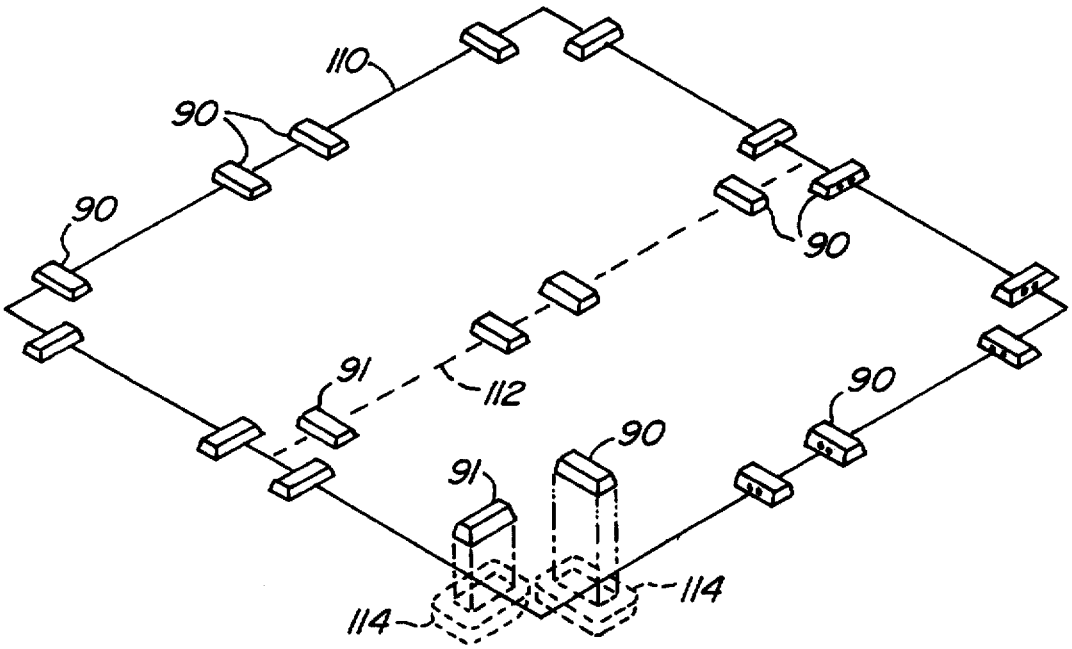
FIG. 8 is an illustration of the footing elements laid out according to a building construction design.

This placement of footings 90 is diagrammatically illustrated in FIG. 8 which shows the footings 90 positioned along a marking of outer boundary 110 of a proposed building structure, and a marking 112 (in phantom) that defines the position on interior wall panels.

Preferably, a sub-foot is prepared for each footing 90 to receive and firmly seat the footing in a manner that aligns the upper surface 91 of each footing generally in a place that contains the upper surfaces 91 of the other footings 90. The sub-foot is formed by a recess 114 carved in the surface on which the footing will sit. The recess is then filled with a liquid concrete. While the concrete is still wet, the footings 90 are placed therein and positioned as desired. The footings 90 are each adjusted, while the sub-foot in which each sits is still wet, so that their upper planar surfaces 91 are made co-planar in conventional fashion.

Once the footings 90 are in place, such as illustrated in FIG. 8, the side board elements 96 are inserted in the vertical notches 92 between pairs of the footings 90 to create the foundation form for the structure. The Reinforcement bars 100 are then inserted through the apertures 98. (although it may be preferable that the reinforcement bars be inserted at the time the footings 90 are put in place, before leveling). The reinforced concrete wall panels are then placed upon the footings, over the periphery outlines 110 and 112. As mentioned above, each of the wall panels are formed to include, in addition to the horizontal reinforcement bars 50, a set of transverse or vertical reinforcement bars (not shown). The vertical reinforcement bars are of a length to provide a terminal portion that extends beyond the bottom edge of the wall panels and into the foundation area defined by a pair of the side panels 96.

The foundation is created by a pour of cement, the terminus' of the downward extending reinforcement bars of the wall panel will be captured when the concrete of the foundation hardens, interlocking the bottom portions of the wall panels to the foundation and to the footings 90. The joint columns between adjacent wall panels (e.g., wall panels 60, 62, 70; FIG. 4) are poured at the same time, integrally forming the resultant joining column with the underlying foundation, creating a unitary structure.

Preferably, the reinforcement bars used in the formation of the wall panels, both horizontal and vertical, are no. 3 reinforcement bars. The elongate vertical reinforcement bars 48 and the zig-zag truss reinforcements 64 are no. 4 reinforcement bars, as are the foundation reinforcement bars 100.

Figure 9:
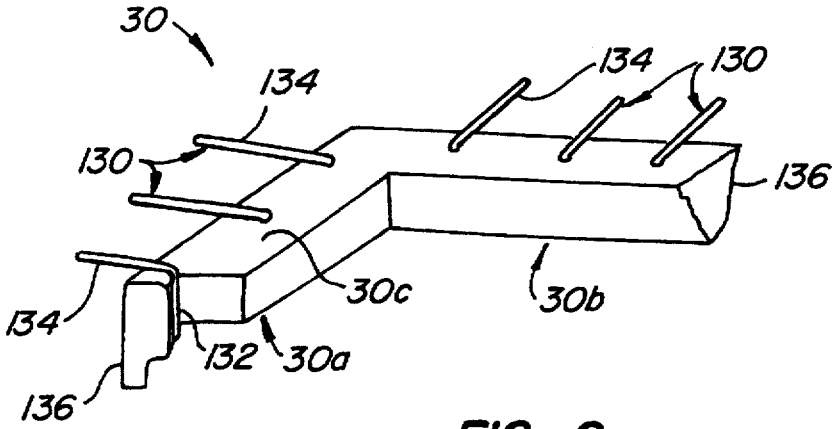
FIG. 9 is a more detailed representation of the support cornice shown in FIG. 2, for providing support to a roof panel.

Construction, according to the present invention, obtains a significant advantage from the support cornice 30 shown in FIG. 2, and more particularly illustrated in FIG. 9. Formed from concrete (although other materials can be used), and reinforced with number 3 reinforcement bars 120, the cornice 30 is constructed to have its two wing sections 30*a*, 30*b*, substantially squared to one another so that they form a right angle. The reinforcement bars 130 have right-angle, interior portions or segments 132 embedded in the cornice clip, and external arms 134 that extend from a vertical surface 136 (when the support cornice is mounted in place) of the support cornice. Preferably, the reinforcement bars 130 are positioned so that what would be the upper edges of the external arms 134 lie substantially in the same plane as defined by the top surface 30*c* of the cornice clip 30.

As will be seen, the right angle formed by the two wing sections 30*a*, 30*b* serves an important function during construction of a building structure employing prefabricated wall panels. In fact, the cornice clips 30 perform two important functions: first, they serve to "square" two adjacent wall panels that are to be located normal to one another; second, once the two wall panels are properly positioned, the cornice clips hold the two wall panels in place.

Both functions may be seen with reference to FIGS. 2 and 9. Assume, in FIG. 2, that wall panel 23 is not yet in the picture, and that the wall panel 22 is in place, awaiting placement of wall panel 23. Before the wall panel 23 is positioned, the cornice clip 30 is positioned with respect to wall panel 22 where the corner between wall panels 22, 23 will be—when wall panel 23 is installed. It will be remembered that the arms 134 emanating from the cornice clip 30 are steel, as is the C-channel 22*a* forming the top edge of the wall panel 22. Thus, the arms 134 can be securely attached to the wall panel 22 by welding the arms 134 along the wing section 30*a* to the C-channel 22*a* of the wall panel Next, the wall panel 23 is brought into place in the construction, and positioned as shown in FIG. 2. The cornice clip 30 now attached to the wall section has its presently free wing section 30*b* located to act as a guide for correct positioning of the wall panel 23. The wall panel 23 is lifted into position adjacent and normal to wall panel 22 and, using the right angle formation of the cornice clip 30, set substantially perpendicular to the wall panel 22. The arm sections 134 of the wings sections 30*b* are then welded to the C-channel 23*a* edge of the wall panel 23 to not only hold the right angle orientation of the two wall panels 22, 23, but to hold the wall panel 23 in place during the remaining construction without the need for braces as are typically used.

It can be seen, therefore, that the cornice clips 30, when employed in the manner described above, serve to expedite prefabricated construction of the type to which the invention relates, create a safer work area, and reduce cost by reducing, if not obviating, the need for wall braces that can be inadvertently collided with and knocked loose to allow a wall panel to fall.

Once the wall panels are placed where desired, and held in place as by the cornice clips 30 in the manner discussed above, the roof panels may now be put in place. Here, providing the roof panels with undulating edges serves another function in addition to facilitating joining two adjacent roof panels.

Figure 10:
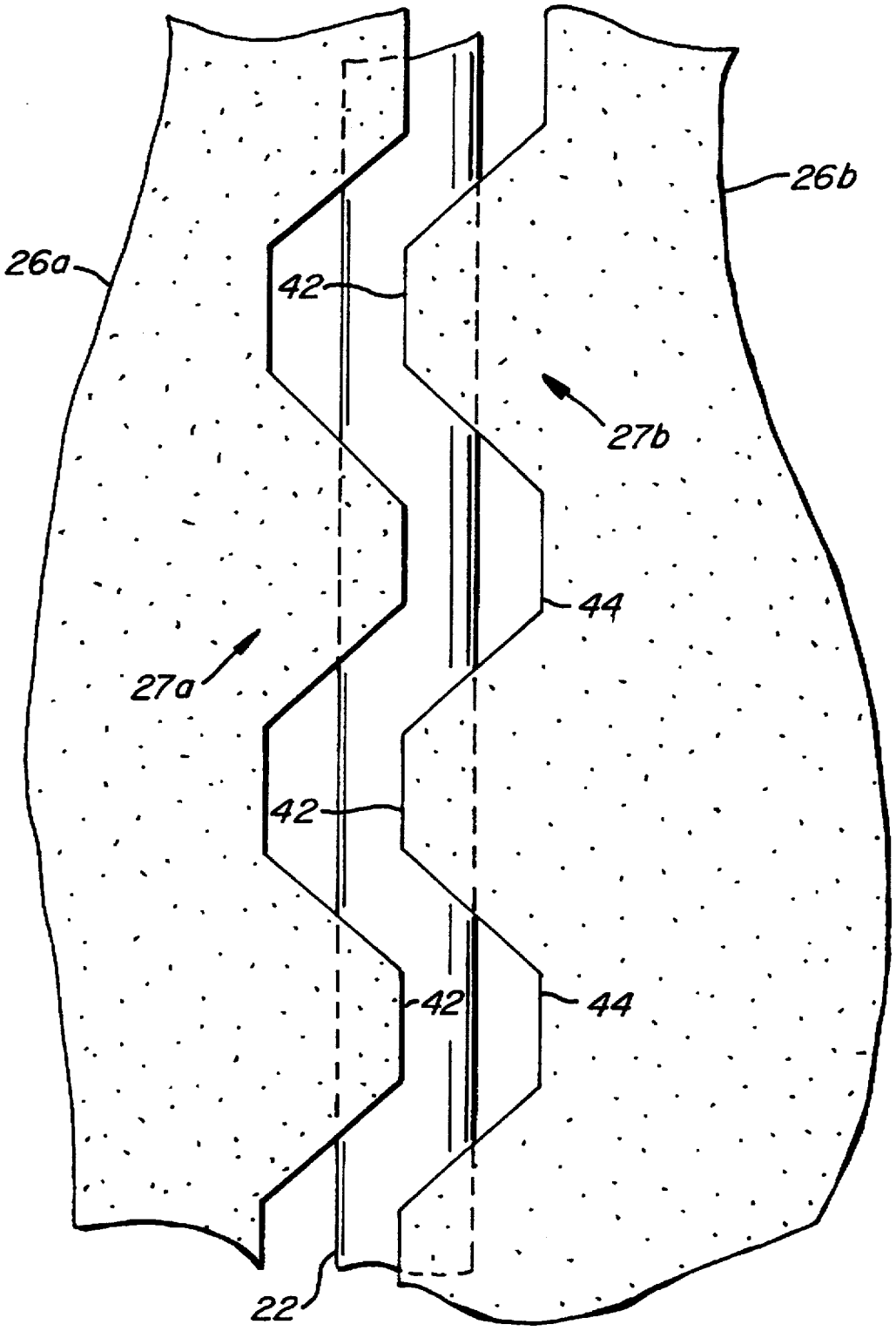
FIG. 10 is an illustration of how the roof panels, constructed in accordance with the present invention, are supported by an underlying wall panel.

Referring to FIG. 10, another advantage of the undulating edge of roof panels may be seen. Shown in FIG. 10, are partial portions of the roof panels 26*a*, 26*b*. Note, as FIG. 10 illustrates, that the convex segments 42 of the roof panels 26*a*, 26*b* serve to support the edges 27*a*, 27*b* of the roof panels 26*a*, 26*b*, respectively, on the underlying wall panel 22, while at the same time allowing space between the edges for formation of a wet knit joint. This space is used to join the two adjacent roof panels in the same manner as two wall panels have been described as being joined, for example wall panels 20, 62 (FIG. 3). Undulating edges 27 of roof panels 26 are positioned to confront one another will in the same fashion as do wall panels 20, 62. Further, although not shown in FIG. 10, the roof panels 26 will similarly have elongate reinforcement bars 46' nested in grooves 46' formed in the convex segments 42 of the undulating edge 27 of each, a zig-zag bar 64, all connected by ends of reinforcement bars extending from concave segments of the undulating to form a connection knitting the roof panels together. Too, once so knitted, a pourable material can be introduced to form the final joint between the two adjacent roof panels.

In summary, there has been disclosed techniques for joining component parts (wall and roof panels, foundation components, etc.) to create a unitary construction well able to resist and withstand various forces and abuse. It will be appreciated by those skilled in this art that there are modifications that can be used. For example, should larger structures be constructed (e.g. multi-level building), requiring thicker wall panels with stronger connections, the system of grooves 46, horizontal reinforcement bars 50, elongate bars 48, and zip-zag bar 64, can be replicated. That is, for a wall panel requiring triple replication, the wall panels would be constructed with three, horizontally-parallel reinforcement bars 50 where only one is shown in the Figures. Similarly, three side-by-side grooves 46 would be formed in the convex segments of the undulating pattern to receive and nest three vertical reinforcement bars 48. Three zig-zag bars 64 are positioned and attached to ends 51 of reinforcement bars 50, and to corresponding bars 48 to, in effect, create three side-by-side versions of what is illustrated in FIG. 3 (or FIG. 4).

What is claimed is:

1. A method for joining first and second planar prefabricated panels for construction of a building structure, including the steps of:

forming each of the first and second prefabricated panels to include therein a plurality of generally parallel reinforcement bars, each of said plurality of reinforcement bars having terminal end portions extending from the first and second peripheral edges of such prefabricated panel;

positioning the first and second prefabricated panels in co-planar relation so that the first peripheral edge of the first prefabricated panel is in confronting, spaced relation to the first peripheral edge of the second prefabricated panel;

providing a zig-zag lattice having a plurality of bends in the space between the confronting first peripheral edges;

attaching the terminal end portions of predetermined ones of the reinforcement bars to the zig-zag lattice structure at selected ones of the bends thereof; and forming a wet-knit joint that includes the zig-zag lattice in the space between the confronting peripheral edges with a pourable material.

2. The method of claim 1, wherein said, step of forming the wet-knit joint includes providing concrete as the pourable material.

3. The method of claim 1, including the step of positioning a third prefabricated panel having first and second parallel peripheral edges substantially normal to the space, the third prefabricated panel having a plurality of parallel reinforcement bars extending between and from the first and second peripheral edges, the first peripheral edge being located in confronting relation to the space, and the step of forming the wet-knit joint including forming the wet-knit joint in juxtaposition with the first peripheral edges of the first, second, and third prefabricated panels.

4. The method of claim 3, including the step of providing another lattice that is formed in the wet-knit joint.

5. The method of claim 4, including the step of forming the another lattice in a zig-zag shape.

6. The method of claim 5, including the step of securing selected ones of the terminal portions of the plurality of reinforcement bars extending from the first peripheral edge of the third prefabricated panel to the another lattice.

7. The method of claim 6, wherein the step of forming the another lattice includes providing the another lattice with a number of bends, and the securing step includes attaching the selected ones of the terminal portions of the plurality of reinforcement bars extending from the first peripheral edge of the third prefabricated panel to predetermined ones of the number of bends.

8. The method of claim 1, wherein the step of forming the first and second panels includes forming the first edges to have an undulating configuration with alternating concave and convex portions.

9. The method of claim 8, including the step of positioning the plurality of reinforcement bars to have their terminal portions extend from the concave portions of the first peripheral edges of each of the first and second panels.

10. The method of claim 9, including the step of placing the concave portions of the first peripheral edge of the first panel in confronting relation with the convex portions of the first peripheral edge of the second panel.

11. A wall system, comprising:

adjacent wall panels having confronting, undulating edge segments with reinforcement bars extending from concave portions of the undulating edge segments;

a lattice structure positioned between the confronting edge segments and attached to the reinforcement bars, the lattice structure including an elongate reinforcement bar having a series of bends to form a zig-zag configuration, wherein each of the reinforcement bars attaches to the lattice structure at a corresponding one of the series of bends; and a pourable material, substantially hardened, between the confronting undulating edge segments and including the lattice structure and the reinforcement bars extending from the concave portions.

12. The wall system of claim 11, wherein the undulating edge segments each include a convex portion adjacent each concave portion, each convex portion having a vertically oriented trough in generally axial alignment with one another, holding an elongate, vertically-oriented reinforcement bar.

13. The wall system of claim 12, wherein the reinforcement bars extending from the concave portions attach to the elongate reinforcement bar.

14. The wall system of claim 11, wherein the attachment of the reinforcement bars to the lattice is such as to tension the reinforcement bars.

15. The wall system of claim 14, wherein the attachment of the reinforcement bars to the lattice is in a manner to tension the lattice structure.

16. The wall system of claim 11, wherein the undulating edge segments each include a convex portion adjacent each concave portion, and including another elongate reinforcement bar placed along the edge segment of at least one of the wall panels, at least certain of the reinforcement bars of the one of the wall panels attaching to the another elongate reinforcement bar in a manner that pulls the another elongate reinforcement bar against the convex portions of the one of the wall panels.

17. The wall system of claim 16, wherein the attachment of the certain of the reinforcement bars to the another elongate vertical reinforcement bar tensions the another elongate reinforcement bar.

18. A method of forming a connection between adjacent pre-formed panels, including the steps of:

forming an edge of each pre-formed panel to have an undulating pattern having a plurality of convex segments and a plurality of concave segments, each of the concave segments having a terminus of a reinforcement bar extending therefrom, the edges of adjacent panels being in spaced confronting relation to one another;

locating a lattice structure between confronting edges of the panels, the lattice structure including a reinforcement bar having bends defining a zig-zag shape;

attaching predetermined ones of the terminus of the reinforcement bars extending from concave segments of each confronting edge to selected ones of the bends of the lattice structure in a manner that places the predetermined ones of the reinforcement bars and the lattice structure in tension; and forming a wet-knit joint between confronting edges of the panels that includes the lattice structure with a concrete material.

19. The method of claim 18, including the step of forming vertical grooves in each convex segment.

20. The method of claim 19, wherein the lattice structure includes a vertical, elongate reinforcement bar located in the groove of each convex segment extending from generally an upper periphery of the pre-formed panel to generally the bottom periphery thereof.

21. The method of claim 20, wherein the attaching step includes the step of attaching the predetermined ones of the terminus of the extending reinforcement bars to the elongate reinforcement bar.

22. A system for constructing a building structure on a surface, comprising:

adjacent wall panels having confronting, undulating edge segments with reinforcement bars extending from concave portions of the undulating edge segments;

a lattice structure positioned between the confronting edge segments and attached to the reinforcement bars;

a pourable material, substantially hardened, between the confronting undulating edge segments and including the lattice structure and the reinforcement bars extending from the concave portions;

for each wall panel, at least a pair of footing elements located on the surface to support the corresponding wall panel and an elongate reinforcement bar extending generally beneath the wall panel through axially-aligned apertures formed in the pair of footing elements;

a foundation wall formed generally beneath each wall panel and between the pairs of footing elements to encompass the elongate reinforcement bar;

a plurality of roof panels supported by the wall panels; and a support cornice at a corner formed by a pair of wall panels that are substantially normal to one another, the support cornice having a support surface substantially co-planar with an upper surface of the pair of wall panels, wherein the support cornice has formed therein a plurality of support reinforcement bars to extend therefrom to overlay the upper surface of the pair of wall panels to hold the support cornice.

23. The system of claim 22, wherein each footing is placed in a recess formed in the surface together with a pourable material, each footing element having an upper support surface substantially co-planar with the upper surfaces of the other footing elements.

24. A wall system, comprising:

adjacent wall panels having confronting, undulating edge segments formed from adjacent convex and concave portions with reinforcement bars extending from at least certain concave portions of the undulating edge segments;

each adjacent wall panel having an elongate, vertically-oriented reinforcement bar positioned adjacent the undulating edge and against the convex portions thereof, and the reinforcement bars extending from the certain concave portions attach to the elongate reinforcement bar;

a lattice structure positioned between the confronting edge segments and attached to the certain reinforcement bars; and a pourable material, substantially hardened, between the confronting undulating edge segments and including the lattice structure, the vertical reinforcement bars, and the certain reinforcement bars extending from the concave portions.

25. The wall system of claim 24, each convex portion of each of the adjacent wall panels having a vertically oriented trough in generally axial alignment with one another, to receive and hold the corresponding elongate reinforcement bar.

* * * * *